United States Patent [19]

Smith

[11] 4,192,440

[45] Mar. 11, 1980

[54] POUR SPOUT FOR A CONTAINER

[75] Inventor: Ernest L. Smith, Kansas City, Mo.

[73] Assignee: Phillips Petroleum Company, Bartlesville, Okla.

[21] Appl. No.: 905,617

[22] Filed: May 12, 1978

[51] Int. Cl.[2] ..... B65D 25/44

[52] U.S. Cl. ..... 222/528; 229/7 R

[58] Field of Search ..... 222/528, 530, 535; 229/7, 17, 51

[56] References Cited

U.S. PATENT DOCUMENTS

| | | | |
|---|---|---|---|
| 2,375,632 | 5/1945 | DiCosmo | 229/51 |
| 2,413,845 | 1/1947 | Read | 229/17 X |
| 2,444,104 | 6/1948 | Marken | 222/528 |
| 2,742,220 | 4/1956 | Lynes | 222/528 X |
| 2,907,512 | 10/1959 | Leone | 229/17 |
| 3,087,657 | 4/1963 | Eckles | 222/531 |
| 3,292,839 | 12/1966 | Pike | 229/7 |

*Primary Examiner*—Stanley H. Tollberg

[57] ABSTRACT

A container having a pour spout formed of paper, plastic or other similar material is provided. The pour spout preform structure is formed from two blanks which are adhered together in a desired manner after being die cut and scored as required to form the pour spout. Additional cuts are made in the two blanks to facilitate opening of the pour spout.

9 Claims, 6 Drawing Figures

POUR SPOUT FOR A CONTAINER

This invention relates to a pour spout for a container. In one specific aspect this invention relates to a pour spout preform structure formed from two blanks made of paperboard, plastic, or other similar material. In still another aspect this invention relates to a pour spout which may be easily opened.

In the manufacture of a container from paperboard, plastic, or other similar materials, it is desirable to form the entire container in one series of related operations. In the past it has been a common practice to make the pouring spouts for such containers out of metal but this caused difficulties in processing the containers. In order to remedy this problem, pour spouts formed from paper, plastic or other similar materials were developed but difficulties were encountered in making pour spouts from paperboard, plastic or other similar materials, in a machine operation, which were easily openable by the consumer.

Accordingly, it is an object of this invention to provide a pour spout for a container. Another object of this invention is to provide a pour spout preform structure formed from two blanks made of paperboard, plastic or other similar materials. Still another object of this invention is to provide a pour spout which may be easily opened.

In accordance with the present invention two flat blanks made of paperboard, plastic or other similar material are die cut and joined to form a pour spout preform structure for a container. Two arcuate sections are cut in one portion of one blank adjacent the pour spout to allow the pour spout to be easily opened. The pour spout preform structure is then attached to a container. Provision is made for a method of allowing the consumer to easily break the cuts, which have been made to form the pour spout, and the arcuate cuts, which have been made to allow the pour spout to be easily opened, so that the pour spout can be opened with a minimum of difficulty.

Other objects and advantages of the invention will be apparent from the description of the invention and the appended claims thereto as well as from the detailed description of the drawings in which:

Figure 1:
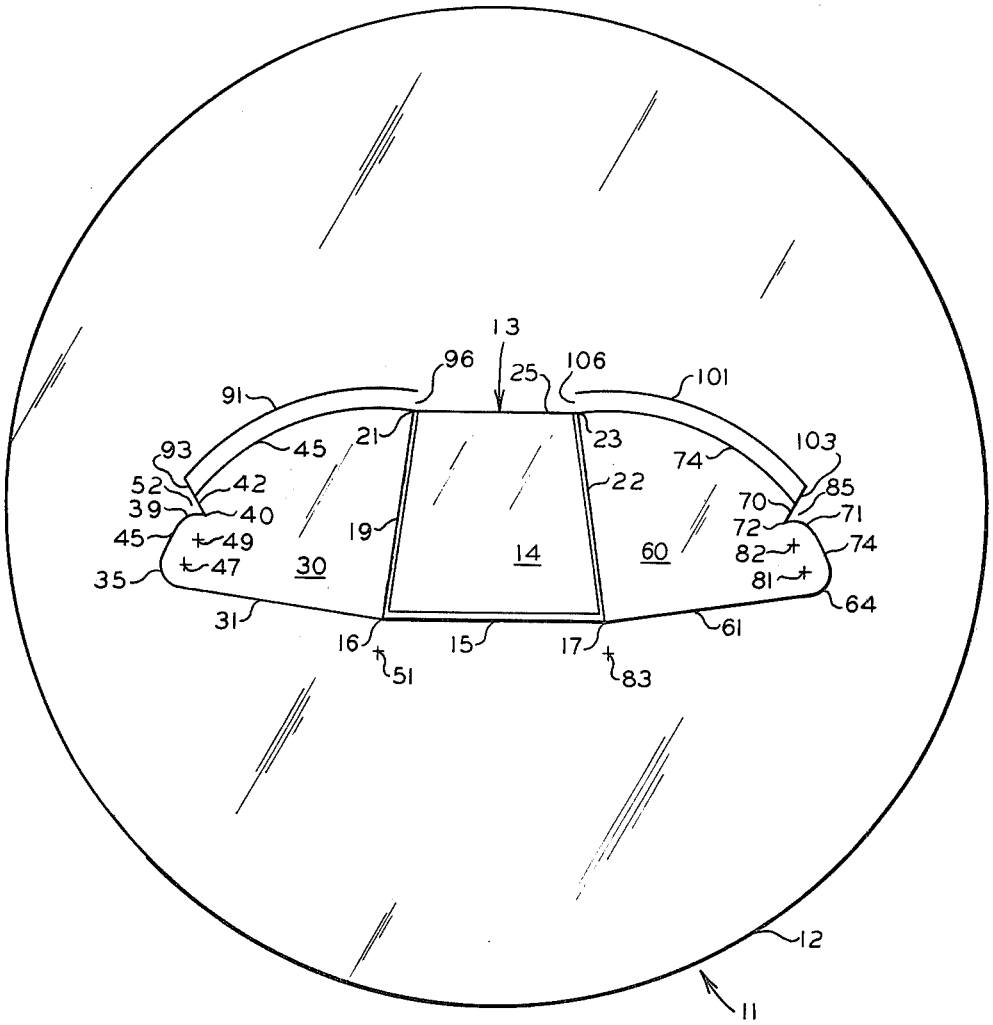
FIG. 1 is a top view of the first blank which is utilized to form the bottom member of the pour spout preform structure with the required cuts having been made in the blank.

The invention is described in terms of a preferred embodiment wherein the pour spout is made of paperboard. The pour spout in this preferred embodiment forms a part of an end closure member which is suitable for use with a container having a circular cross section perpendicular to the elongated axis of the container, e.g. a cylindrical container or a frustoconical container. The applicability of the invention, however, extends to pour spouts made of other substances such as plastics and also extends to pour spouts which form a part of closure members suitable for use in containers having a shape other than round as well as pour spouts which may form a part of the side of a container.

The preferred structure of the pour spout preform structure is set forth in the drawings. The outer geometrical shape may be changed or the size may be scaled up or down for smaller or larger containers with the same general proportions of the preferred embodiment shown on the drawings.

The term die cut as used in this description refers to a cut made completely through a blank or to a cut made almost but not completely through the blank. The term score line refers to a depression, e.g. formed by compression of the blank, which weakens the blank so that the blank can be easily bent at the score line.

Referring now to the drawings and in particular to FIG. 1, a flat paperboard blank 11 is cut in a generally circular shape having an outside edge 12. The flat paperboard blank 11 has a generally C-shaped die cut 13 which defines the sides of first and second side panels 30, 60 and defines the top edge 25 of the central chute floor of the pour spout. The score line 15 extends between one end 16 of the C-shaped die cut 13 and the second end 17 of the C-shaped die cut 13. The area enclosed by the generally C-shaped die cut 13 and score line 15 constitutes the pour spout section of the paperboard blank 11; the area outside the generally C-shaped die cut 13 and score line 15 will be referred to as the peripheral section of blank 11. The score line 15 is generally parallel to the die cut line 25 which forms the top edge of the bottom portion 14 of the central chute floor of the pour spout. The die cut line 25, having a first end 21 and a second end 23, will generally be shorter in length than the score line 15, and a line drawn perpendicular to and through the center point of score line 15 will generally intersect the center point of die cut line 25. Score line 19 extends from the first end 16 of the C-shaped die cut 13 to the first end 21 of the die cut line 25. The score line 22 extends from the first end 17 of the C-shaped die cut 13 to the second end 23 of the die cut line 25. The score lines 19 and 22 form hinges between the chute floor 14 of the pour spout and the first and second side panels 30, 60 of the pour spout, respectively. The area bounded by score lines 15, 19, and 22 and die cut line 25 forms the bottom portion 14 of the central chute floor for the pour spout. The bottom portion 14 has a generally trapezoidal shape with score line 15 forming the base, score lines 19 and 22 forming the sides, and die cut line 25 forming the top.

The first and second side panels 30, 60 of the pour spout are similar to each other in geometrical construction. The first side panel 30 of the pour spout is connected to the bottom portion 14 of the central chute floor by score line 19 as has been previously stated. In addition to score line 19, the first side panel 30 is bounded by the portion of the C-shaped die cut which extends from the end 16 of the C-shaped die cut to the end 21 of die cut line 25. This portion of the C-shaped die cut is generally made up of an arcuate die cut 45 and a generally straight die cut 31. The radius of the arc of die cut 45 from the first end 21 of the die cut line 25 increases with distance from end point 21. The generally straight line die cut 31, which defines a part of the edge of the first side panel 30, extends from the first end point 16 of score line 15 in such a manner that an angle of approximately 90° is formed between the straight line die cut 31 and the score line 19.

The ends of the arcuate die cut 45 and the straight line die cut 31 remote from score line 19 are joined by a relatively short arcuate die cut line 35 having a center at point 47. The arcuate die cut line 35 provides a smooth transition from the straight line die cut line 31 and the arcuate die cut 45. Thus side panels 30, 60 are very similar to quarter circles.

The arcuate die cut 45 is interrupted by a generally V-shaped die cut 52 located in the portion of side panel 30 remote from the first end point 21 of die cut line 25. One edge of the V-shaped die cut 52 is formed by an arcuate die cut line 39 having a center at point 49. The arcuate die cut line 39 intersects the remote, or lower (as illustrated in FIG. 1) portion of the arcuate die cut line 45 and extends to the apex point 40 of the V-shape die cut 52. The second edge of the V-shaped die cut 52 is formed by a generally straight line die cut 42 which extends from the apex point 40 to the arcuate die cut line 45 in such a manner as to form the generally V-shaped die cut 52 with the apex thereof being directed generally toward score line 19.

In the illustrated embodiment, the first side panel 30 of the pour spout is formed in such a manner that a circular arc having a center at the end 16 of the C-shaped die cut can be drawn from the end 21 of die cut line 25 through the apex point 40 to the intersection of the straight line die cut 31 and the arcuate die cut 35. A second circular arc having a center at point 51 can be drawn from the end 21 of die cut line 25 which would at least generally contain arcuate die cut line 45. Straight die cut line 42 and the arcuate die cut line 39 connects the circular arc through point 40 to the circular arc which forms arcuate die cut line 45 in such a manner that the V-shaped cut 52 is formed.

The second side panel 60 of the pour spout is connected to the bottom portion 14 of the central chute floor by score line 22 as has been previously stated. In addition to score line 22 the second side panel 60 is bounded by the portion of the C-shaped die cut which extends from the end 17 of the C-shaped die cut to the end 23 of die cut line 25. This portion of the C-shaped die cut is generally made up of an arcuate die cut 74 and a straight line die cut 61. The radius of the arc of die cut line 74 from the second end 23 of the die cut line 25 increases with distance from end point 23. The generally straight line die cut 61, which defines a part of the edge of the second side panel 60, extends from the second end point 17 of score line 15 in such a manner that an angle of approximately 90° is formed between the straight line die cut 61 and the score line 22.

The ends of the arcuate die cut 74 and the straight line die cut 61 remote from score line 22 are joined by a relatively short arcuate die cut line 64 having a center at point 81. The arcuate die cut line 64 provides a smooth transition from the straight line die cut line 61 and the arcuate die cut 74.

The arcuate die cut 74 is interrupted by a generally V-shaped die cut 85 located in the portion of the side panel 60 remote from the first end point 23 of die cut line 25. One edge of the V-shaped die cut 85 is formed by an arcuate die cut line 71 having a center at point 82. the arcuate die cut line 71 intersects the remote or lower (as illustrated in FIG. 1) portion of the arcuate die cut line 74 and extends to the apex point 72 of the V-shaped die cut 85. The second edge of the V-shaped die cut 85 is formed by a generally straight line die cut 70 which extends from the apex point 72 to the arcuate die cut line 74 in such a manner as to form the generally V-shaped die cut 85 with the apex thereof being directed generally toward score line 22.

In the illustrated embodiment, the second side panel 60 of the pour spout is formed in such a manner that a circular arc having a center at the end 17 of the C-shaped die cut can be drawn from the end 23 of die cut line 25 through the apex point 72 to the intersection of the straight line die cut 61 and the arcuate die cut 64. A second circular arc having a center at point 83 can be drawn from the end 23 of die cut line 25 which would at least generally contain arcuate die cut line 74. Straight die cut line 70 and the arcuate die cut 71 connects the circular arc through point 72 to the circular arc which forms arcuate die cut line 74 in such a manner that the V-shaped cut 85 is formed.

The V-shaped cut 85 of the second side 60 of the pour spout together with the V-shaped cut 52 of the first side of the pour spout act as stops and are utilized to prevent the pour spout from being opened so far that it would be difficult to close the pour spout. This feature is made possible by the fact that a radial line extending from the end 16 of the C-shaped die cut to the intersection of the arcuate die cut 45 and the arcuate die cut 35 or from the end 17 of the C-shaped die cut to the intersection of the arcuate die cut 74 and the arcuate die cut 64 would be longer than a radial line extending from the end 16 to point 21 or the end 17 to point 23. Because of this, as the pour spout is opened, the container will exert increasing pressure on the portion of the first and second sides of the pour spout formed by arcuate die cut line 45 and arcuate die cut line 74 until the pour spout is open to the point where the portion of the pour spout preform adjacent to die cut line 45 and die cut line 74 can snap into the notches formed by V-shaped sections 52 and 85.

To facilitate opening of the pour spout, an arcuate die cut line 91 having an arc similar to arcuate die cut line 45 is also cut in the peripheral section of blank 11 from a point generally colinear with score line 19 to a second point generally colinear with cut line 42. The arcuate die cut line 91 forms a circular arc having a center genrally at point 51. The substantially straight die cut line 93 is cut so as to be generally an extension of the straight die cut line 42 in such a manner that the arcuate strip bounded by arcuate die cut lines 91 and 45 and straight die cut line 93 is free from the contiguous portions of blank 11 at the end bounded by die cut line 93. The end 96 of the arcuate strip bounded by arcuate die cut lines 91 and 45 and straight die cut line 93 which would generally form an extension of score line 19, is not cut.

In like manner, an arcuate die cut line 101 having an arc similar to arcuate die cut line 74 is also cut in the peripheral section of blank 11 from a first end point generally colinear with score line 22 to a second end point generally colinear with cut line 70. The arcuate die cut line 101 forms a circular arc having a center generally at point 83. The straight die cut line 103 is cut so as to be generally an extension of die cut line 70 in such a manner that the arcuate strip bounded by arcuate die cut lines 101 and 74 and straight die cut line 103 is free from the contiguous portions of blank 11 at the end bounded by the straight die cut line 103. The end 106 of the arcuate strip bounded by die cut lines 101 and 74 and straight die cut line 103 which would generally form an extension of score line 22, is not cut.

The two side panels 30, 60, and the bottom portion 14 of the central chute floor, which are illustrated in FIG. 1 and which have been described in the preceding paragraphs, form the bottom part of the pour spout. The top part of the pour spout is formed as is illustrated in FIG. 2.

Figure 2:
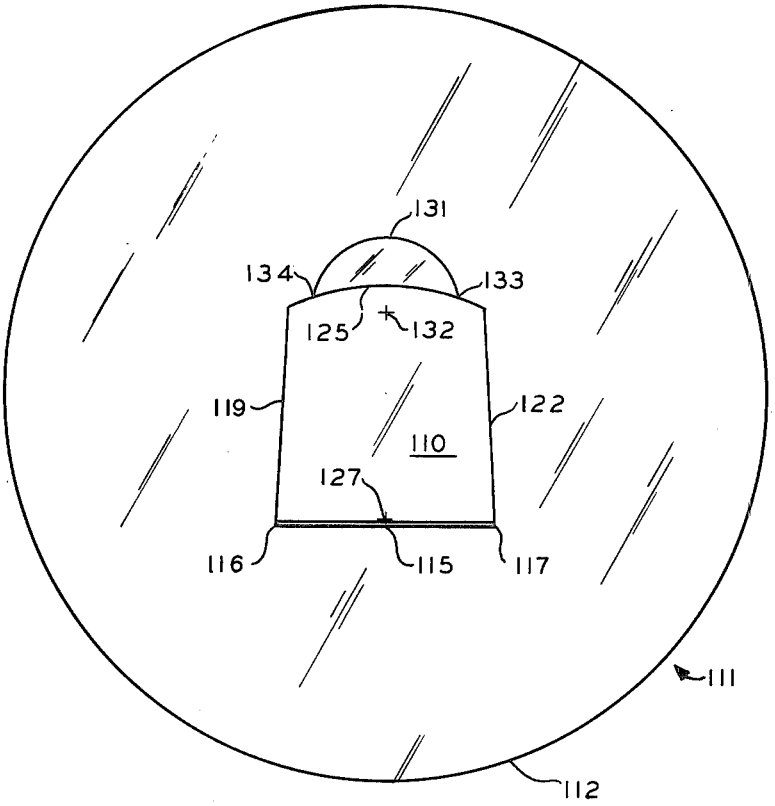
FIG. 2 is a top view of the second blank which is utilized to form the top member of the pour spout preform structure with the required cuts having been made in the blank.

Referring now to FIG. 2, a flat paperboard blank 111 is cut in a generally circular shape having an outside edge 112. In the illustrated embodiment, the flat paperboard blank 111 is preferably smaller in diameter than blank 11. The area bounded by the straight score line 115; the straight die cut lines 119, 122; and the arcuate die cut line 125 forms the top portion or flap 110 of the central chute floor for the pour spout. The top portion 110 of the central chute floor is of the same general geometric configuration as the bottom portion 14 of the central chute floor illustrated in FIG. 1. The top portion 110 of the central chute floor is generally trapezoidal in shape except for the arcuate die cut line 125 which forms a convex circular arc rather than a straight line as would be required in a true trapezoidal shape. The straight score line 115 forms the base of the trapezoidal shape and the straight die cut lines 119 and 122 form the sides. The top portion of the trapezoidal shape which would normally be a straight line is replaced by die cut line 125 which forms a circular arc having a center at point 127. The top portion 110 of the central chute floor may also be thought of as being generally U-shaped with straight die cut lines 119 and 122 and arcuate die cut line 125 forming the U-shape. The straight score line 115 extends between the ends 116 and 117 of the U-shape. The angle formed between score line 115 and die cut line 119 is equal to the angle formed between score line 115 and die cut line 122 and both of these angles are equal to or slightly greater than the angle formed by score line 15 and score line 19 or the angle formed by score line 15 and score line 22, illustrated in FIG. 1, with the length of score line 115 being equal to or slightly greater than the length of score line 15.

The section of blank 111 bounded by the arcuate die cut line 131, cut in the area outside of the area bounded by the U-shaped die cut and score line 115 (referred to hereinafter as the wall of the pour spout closure structure), and the arcuate die cut line 125 is removed from the blank to facilitate easy access to the top edge of the pour spout. Die cut line 131 forms a circular arc having a center generally at point 132, with points 127 and 132 lying generally on a line perpendicular to score line 115, generally at the midpoint of score line 115. The section of blank 111 bounded by the arcuate die cut lines 125 and 131 is outside the top portion 110 of the central chute floor but is adjacent the base of the U-shaped top portion 110.

Figure 3:
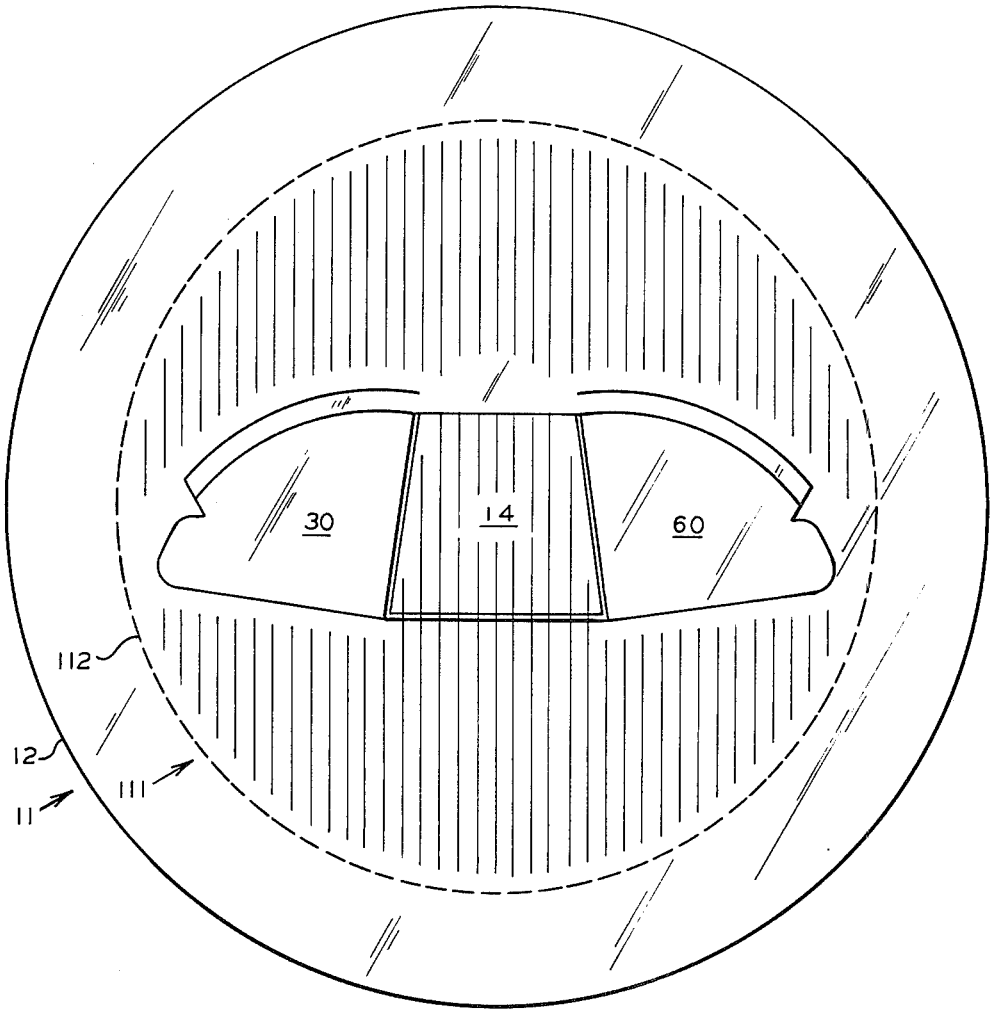
FIG. 3 is a bottom view of the pour spout preform structure after the first and second blanks have been joined.

FIG. 3 shows the manner in which the blank 11 is sealed to the blank 111. The view is from the bottom of the pour spout preform structure. The outside edge 12 of blank 11 is shown as a solid line. The outside edge 112 of blank 111 is shown as a dotted line. The blanks 11 and 111 are scored and cut as has been previously described in connection with FIGS. 1 and 2. Blank 111 is attached to blank 11 by an adhesive or other suitable bond in the shaded areas as is shown in FIG. 3. The top portion or flap 110 of the central chute floor is bonded to the bottom portion 14 of the central chute floor. The blank 11 is also bonded to the blank 111 in the wall area of blank 111 which is outside the pour spout structure illustrated in FIGS. 1 and 2.

The side panels 30, 60 of the bottom portion of the pour spout structure and the arcuate strips which are provided to facilitate opening of the pour spout are not bonded to the top portion of the pour spout illustrated in FIG. 2.

As has been previously stated, blank 11 preferably has a larger diameter than blank 111 as is illustrated in FIG. 3. In a preferred embodiment the portion of blank 11 which extends past blank 111 is bent upward towards the top portion of the pour spout to form an upwardly depending skirt to facilitate joining of the pour spout preform structure formed by blanks 11 and 111 to the open end of a round container.

Figure 4:
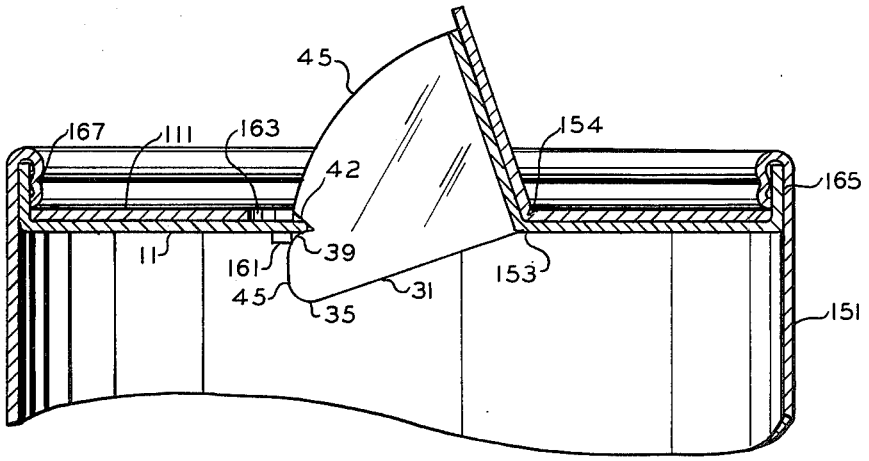
FIG. 4 is a partial side view of a container cut in half showing a side view of the pour spout and showing the manner in which the pour spout preform structure is attached to the container as an end closure.

FIG. 4 shows a side view, in cross section, of the formed pour spout in an open position together with the manner in which the pour spout preform structure formed by blanks 11 and 111 may be joined to a round container 151. In the side view of FIG. 4, the point 153 corresponds to an end view of score line 15 illustrated in FIG. 1. The point 154 corresponds to an end view of score line 115 illustrated in FIG. 2. The top member 110 of the central chute floor of the pour spout and the bottom member 14 of the central chute floor of the pour spout corresponds to the similarly numbered members in FIGS. 1 and 2. Die cut lines 31, 35, 39, 42, and 45 correspond to the similar die cut lines shown in FIG. 1. The small projection 161 corresponds to the arcuate strip bounded by die cut lines 101, 103 and 74 which has been broken loose when the pour spout was opened. The opening 163 corresponds to the portion of blank 111 bounded by die cut lines 131 and 125 which has been removed.

In this preferred embodiment the pour spout preform structure formed from blanks 11 and 111 is inserted into a round container sidewall 151. The upwardly depending skirt 165 associated with the pour spout preform structure is formed as previously described. The edge 167 of the round container sidewall 151 is then bent down over the skirt 165 of the closure member and the edge 167 and flange 165 are sealed by any suitable means. For example, if the round container sidewall 151 and the closure member formed from blanks 11 and 111 are coated with polyethylene, heat sealing can be employed.

Figure 5:
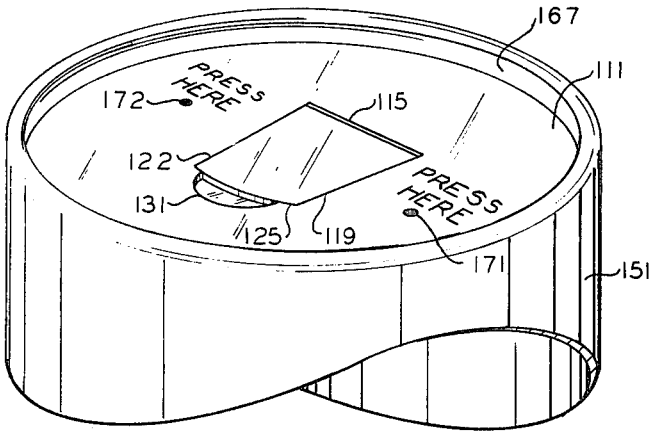
FIG. 5 is a view in perspective of the container with the pour spout preform structure attached as an end closure and the pour spout closed.

FIG. 5 is a perspective view of the round container sidewall 151 with the pour spout preform structure formed from blanks 11 and 111 inserted. Only the part of the pour spout preform structure formed by blank 111 is visible in FIG. 5. The edge 167 of the round container sidewall 151 is shown rolled over the skirt 165 of the pour spout preform structure formed from blanks 11 and 111. The pour spout is shown in a closed position. Score line 115 and die cut lines 119, 122, 125, and 131 correspond to the similar lines illustrated in FIG. 2.

To open the pour spout for the first time the user presses on points 171 and 172 which are directly over the two side panels 30, 60 of the pour spout which were formed in blank 11 and illustrated in FIG. 1. This has the effect of distorting th combined blanks 11 and 111 and breaking loose the two side panels 30, 60 of the pour spout, the arcuate strip bounded by die cut lines 91, 93 and 45 and the arcuate strip bounded by die cut lines 101, 103 and 74, all illustrated in FIG. 1. The sections are broken loose at the die cut lines previously described in a manner such that the loosened sections remain partially folded outward from the lower surface of blank 11. The user then inserts a fingernail or other similar object in the indention left by the removal of the section of blank 11 bounded by die cut lines 131 and 125 and pulls upward. The arcuate section bounded by die cut lines 91, 93 and 45 and the arcuate section bounded by die cut lines 101, 103 and 74 of blank 11, illustrated in FIG. 1, are extended outwardly away from the two sides of the pour spout when pressure is first applied to the pour spout to open it. The pour spout opens easily under nominal pressure because of the use of the arcuate sections previously described and the use of pressure on points 171 and 172 to break the side panels 30, 60 of the pour spout loose and to break the arcuate sections, illustrated in FIG. 1, loose.

Figure 6:
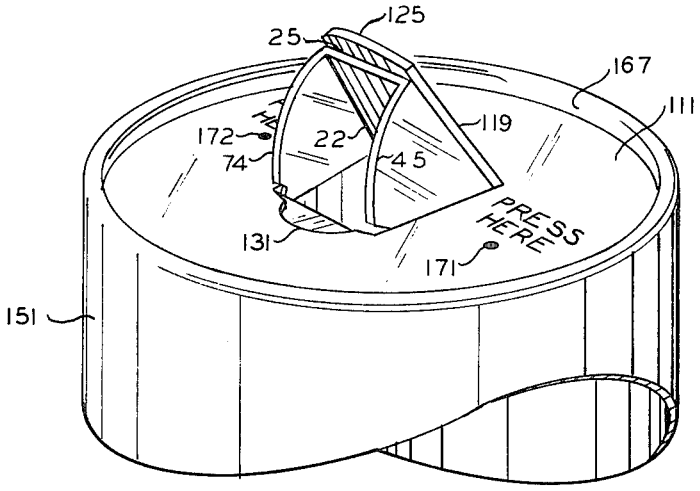
FIG. 6 is a view in perspective of the container with the pour spout preform structure attached and the pour spout open.

FIG. 6 is a second perspective view of the round container sidewall 156 with the pour spout preform structure formed from blanks 11 and 111 inserted. The pour spout is in an open position in the view shown in FIG. 6. Parts of both blanks 111 and 11 are visible in the view shown in FIG. 6. The edge 167 of the round container sidewall is again shown folded over the flange of the closure member. Die cut lines 25, 45 and 74 and score line 22 correspond to the associated lines illustrated in FIG. 1. Die cut lines 119, 125 and 131 correspond to the associated lines illustrated in FIG. 2. Points 171 and 172 are used as previously described in the description of FIG. 5.

While the invention has been described in terms of the presently preferred embodiment, reasonable variations and modifications are possible, by those skilled in the art, within the scope of the described invention and the appended claims. Modification of the geometric shape of the arcuate strips which facilitate opening of the pour spout as to the length, width or shape of the strips is within the scope of the invention. Also the arcuate strips could be formed in one continuous strip extending at least partially around the C-shaped die cut 13 with the ends thereof connected to the blank 11 rather than being connected in the middle as is illustrated in FIG. 1. These and other reasonable variations of the pour spout structure are within the scope of the invention.

That which is claimed is:

1. A pour spout preform structure adapted to form a pour spout comprising an inner layer member and an outer layer member:

said inner layer member having a generally C-shaped die cut therein and a first score line extending between the ends of said generally C-shaped die cut, the portion of said inner layer member outside of the area enclosed by said generally C-shaped die cut and said first score line constituting a peripheral section, the portion of said inner layer member enclosed by said generally C-shaped die cut and said first score line constituting a pour spout section, said pour spout section being integrally connected to said peripheral section along said first score line, second and third score lines being formed in said pour spout section, each of said second and third score lines extending, in such a manner that said second and third score lines never cross, from a point at least closely adjacent a respective end of said generally C-shaped die cut to a respective point on the side of said generally C-shaped die cut generally opposite the respective ends of said generally C-shaped die cut to thereby divide said pour spout section into a central chute floor and first and second side panels, said central chute floor being integrally connected to said peripheral section along said first score line and being integrally connected to said first side panel along said second score line and to said second side panel along said third score line; said peripheral section having at least one die cut formed therein which is an arcuate strip extending generally alongside at least a part of the edge of said generally C-shaped die cut which forms the edge of said first side panel and the edge of said second side panel and which is generally opposite said first score line; and said outer layer member having a generally U-shaped die cut therein and a fourth score line formed in said outer layer member extending between the ends of said generally U-shaped die cut, the portion of said outer layer member inside the area enclosed by said generally U-shaped die cut and said fourth score line constituting a flap section and the portion of said outer layer member outside the area enclosed by said generally U-shaped die cut and said fourth score line constituting a wall section, said outer layer member being positioned against said inner layer member with said fourth score line overlying said first score line of said inner layer member and said flap section being bonded to and overlying said central chute floor.

2. A pour spout preform structure in accordance with claim 1 wherein said central chute floor is generally trapezoidal in form, the base of the trapezoid being formed by said first score line, the sides of said trapezoid being formed by said second and third score lines respectively, and top of said trapezoid being formed by the edge of said generally C-shaped die cut opposite said first score line.

3. A pour spout preform structure in accordance with claim 2 wherein the angle, formed by said second score line and the edge of said generally C-shaped die cut extending from the end of said generally C-shaped die cut adjacent to said second score line, is an angle of approximately 90° and the angle, formed by said third score line and the edge of said generally C-shaped die cut extending from the end of said generally C-shaped die cut adjacent to said third score line, is an angle of approximately 90°.

4. A pour spout preform structure in accordance with claim 1 wherein said at least one die cut in said peripheral section forms a first and second arcuate strip;

said first arcuate strip extending generally along at least a part of the edge of said generally C-shaped die cut which forms the edge of said first side panel and which is generally opposite said first score line; and said second arcuate strip extending generally along at least a part of the edge of said generally C-shaped die cut which forms the edge of said second side panel and which is generally opposite said first score line.

5. A pour spout preform structure in accordance with claim 4 wherein:

said first arcuate strip is integrally attached to said peripheral section at a line which would be an extension of said second score line across the edge of said generally C-shaped die cut, opposite said first score line;

said first arcuate strip is free from said peripheral section at the end of said arcute strip opposite the end of said arcuate strip which is integrally attached to said peripheral section;

said second arcuate strip is integrally attached to said peripheral section at a line which would be an extension of said third score line across the edge of the generally C-shaped die cut, opposite said first score line; and said second arcuate strip is free from said peripheral section at the end of said arcuate strip opposite the end of said arcuate strip which is integrally attached to said peripheral section.

6. A pour spout preform structure in accordance with claim 1 additionally comprising a die cut in said wall section, said die cut in said wall section having the form of an arc which extends generally from a first point, on the edge of said generally U-shaped die cut which is opposite said fourth score line, to a second point, on the edge of said generally U-shaped die cut which is opposite said fourth score line, said first point and said second point being located generally towards respective ends of the edge of said generally U-shaped die cut which is opposite said fourth score line, the part of said wall section, bounded by the die cut in said wall section and the edge of said generally U-shaped die cut opposite said fourth score line, being completely removed.

7. A pour spout preform structure in accordance with claim 1 additionally comprising first and second pressure points marked on the upper surface of said outer layer member, said first and second pressure points being located generally above said first and second side panels respectively, pressure on said first and second pressure points being utilized to break said first and second side panels loose from said at least one die cut in said peripheral section of said inner layer member.

8. A pour spout preform structure in accordance with claim 1 wherein said pour spout section has first and second generally V-shaped notches;

said first V-shaped notch being generally located at a first position which is on the edge of said generally C-shaped die cut which forms said first side panel and which is generally opposite said first score line, said first position being generally opposite said second score line; and said second V-shaped notch being generally located at a second position which is on the edge of said generally C-shaped die cut which forms said second side panel and which is generally opposite said first score line, said second position being generally opposite said third score line.

9. A pour spout preform structure in accordance with claim 1 wherein said inner layer member and said outer layer member are circular in shape, said inner layer member having a large diameter than said outer layer member, the portion of said inner layer member which exceeds said outer layer member being bent upward toward said outer layer member to form a skirt.

* * * * *

UNITED STATES PATENT AND TRADEMARK OFFICE

CERTIFICATE OF CORRECTION

PATENT NO. : 4,192,440

DATED : March 11, 1980

INVENTOR(S) : Ernest L. Smith

It is certified that error appears in the above-identified patent and that said Letters Patent are hereby corrected as shown below:

Column 10, Claim 9, Line 25, "large" should read --- larger ---.

Signed and Sealed this

*Second* Day of *September 1980*

[SEAL]

*Attest:*

SIDNEY A. DIAMOND

*Attesting Officer*

*Commissioner of Patents and Trademarks*